US009269293B2

(12) United States Patent
Kim

(10) Patent No.: US 9,269,293 B2
(45) Date of Patent: Feb. 23, 2016

(54) ORGANIC LIGHT EMITTING DIODE DISPLAY

(71) Applicant: Samsung Display Co., Ltd., Yongin, Gyeonggi-Do (KR)

(72) Inventor: Yang-Wan Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 97 days.

(21) Appl. No.: 13/791,759

(22) Filed: Mar. 8, 2013

(65) Prior Publication Data

US 2013/0335397 A1 Dec. 19, 2013

(30) Foreign Application Priority Data

Jun. 13, 2012 (KR) ..... 10-2012-0063223

(51) Int. Cl.
*G09G 3/32* (2006.01)
*G09G 3/00* (2006.01)

(52) U.S. Cl.
CPC ..... *G09G 3/3208* (2013.01); *G09G 3/006* (2013.01); *G09G 3/3233* (2013.01); *G09G 3/3258* (2013.01); *G09G 3/3266* (2013.01); *G09G 3/3291* (2013.01); *G09G 2300/0408* (2013.01);

(Continued)

(58) Field of Classification Search
CPC ..... G09G 3/006; G09G 2300/0842; G09G 2300/0861; G09G 2300/0819; G09G 2300/0426; G09G 2320/043; G09G 3/3233; G09G 3/3208; G09G 3/3258; G09G 2300/0408; G09G 2320/029; G09G 2320/0295; G09G 3/2014; G09G 2300/00; G09G 2310/0262; G09G 2330/12; G09G 2330/04
USPC ..... 345/76–79, 84, 90–92, 204, 206; 315/169.3; 324/760.01, 760.02, 324/762.01, 762.02, 762.07
See application file for complete search history.

(56) References Cited

U.S. PATENT DOCUMENTS 5,936,687 A 8/1999 Lee
6,023,260 A 2/2000 Higashi (Continued)

FOREIGN PATENT DOCUMENTS

EP 1 843 318 A2 10/2007
EP 2 299 431 A1 3/2011

(Continued)

OTHER PUBLICATIONS

EPO Search Report dated Aug. 9, 2013, for corresponding European Patent application 13171909.8, (6 pages).

*Primary Examiner* — Lun-Yi Lao
*Assistant Examiner* — Md Saiful A Siddiqui
(74) *Attorney, Agent, or Firm* — Lewis Roca Rothgerber Christie LLP

(57) ABSTRACT

A display including: pixels; a gate driver for supplying a gate signal to gate lines; a lighting test circuit coupled to a first input line (for transmitting a lighting test signal), and a second input line (for transmitting a test control signal), the light test circuit being for supplying the lighting test signal to data lines according to the test control signal; a first power supply line for supplying a gate high level voltage to the gate driver and at a periphery of the gate driver and the lighting test circuit; and a second power supply line for supplying a gate low level voltage to the gate driver and at a periphery of the gate driver and the lighting test circuit. The second input line is coupled to the first power supply line or the second power supply line through a resistor.

10 Claims, 9 Drawing Sheets

(52) U.S. Cl.
CPC ..... *G09G 2300/0426* (2013.01); *G09G 2300/0819* (2013.01); *G09G 2300/0861* (2013.01); *G09G 2310/0262* (2013.01); *G09G 2310/0286* (2013.01); *G09G 2330/04* (2013.01); *G09G 2330/12* (2013.01)

(56) References Cited

U.S. PATENT DOCUMENTS

| | | | | |
|---|---|---|---|---|
| 6,362,798 | B1 | 3/2002 | Kimura et al. | |
| 2004/0222815 | A1 | 11/2004 | Kim et al. | |
| 2007/0046581 | A1* | 3/2007 | Kwak et al. | 345/68 |
| 2007/0103404 | A1 | 5/2007 | Shin | |
| 2008/0048946 | A1* | 2/2008 | Kwak | 345/76 |
| 2008/0054798 | A1* | 3/2008 | Jeong et al. | 313/504 |
| 2008/0068309 | A1* | 3/2008 | Kwak et al. | 345/82 |
| 2009/0262048 | A1* | 10/2009 | Park et al. | 345/76 |
| 2009/0283774 | A1* | 11/2009 | Shin et al. | 257/72 |
| 2011/0080173 | A1* | 4/2011 | Kim et al. | 324/403 |
| 2011/0291098 | A1* | 12/2011 | Hayafuji | 257/59 |

FOREIGN PATENT DOCUMENTS

| | | | |
|---|---|---|---|
| KR | 10-0759686 | | 9/2007 |
| KR | 1020080033630 | A | 4/2008 |
| KR | 1020090118580 | A | 11/2009 |
| KR | 1020110024450 | A | 3/2011 |

* cited by examiner

ORGANIC LIGHT EMITTING DIODE DISPLAY

CROSS REFERENCE TO RELATED APPLICATION

This application claims priority to and the benefit of Korean Patent Application No. 10-2012-0063223 filed in the Korean Intellectual Property Office on Jun. 13, 2012, the entire contents of which are incorporated herein by reference.

BACKGROUND

1. Field

Embodiments of the present invention relate to an organic light emitting diode (OLED) display.

2. Description of the Related Art

The organic light emitting diode display has a self emissive characteristic, and differs from a liquid crystal display (LCD) in that it does not require a separate light source and has a relatively small thickness and weight. Furthermore, the organic light emitting diode display exhibits high quality characteristics such as low power consumption, high luminance, and short response time.

Organic light emitting diode (OLED) displays may include a pixel unit including a plurality of pixels, a gate driver for supplying a gate signal to the pixel unit, a data driver for supplying a data signal to the pixel unit, and a lighting test circuit used when performing a lighting test to confirm lighting of pixels. Here, the lighting test circuit may include a plurality of thin film transistors to supply a lighting test signal to the data lines by a corresponding test control signal supplied from the outside.

The thin film transistors included in the lighting test circuit and the lines supplying the test control signal and the lighting test signal to the thin film transistors may be exposed to an electrostatic discharge (ESD) flowing in from the outside such that they may be easily damaged by the ESD in a process of manufacturing the organic light emitting diode (OLED) display or after the manufacturing of the organic light emitting diode (OLED) display is completed.

If the thin film transistors of the lighting test circuit and the lines supplying the test control signal and the lighting test signal to the thin film transistors are damaged by the ESD, the lighting test may not be effectively performed, and a driving defect of the organic light emitting diode (OLED) display may be generated.

The above information disclosed in this Background section is only for enhancement of understanding of the background of the described technology and therefore it may contain information that does not form the prior art that is already known in this country to a person of ordinary skill in the art.

SUMMARY

Aspects of the present invention provide for an organic light emitting diode (OLED) display that suppresses a defect caused by an ESD.

An organic light emitting diode (OLED) display according to an embodiment of the present invention includes: a pixel unit including a plurality of pixels at crossing regions of gate lines and data lines and at a center region of a panel; a gate driver configured to supply a gate signal to the gate lines, the gate driver being at one side of the panel; a lighting test circuit coupled to a first input line, configured to transmit a lighting test signal, and a second input line, configured to transmit a test control signal, the light test circuit being at an other side of the panel, and being configured to supply the lighting test signal to the data lines according to the test control signal; a first power supply line configured to supply a gate high level voltage to the gate driver and at a periphery of the gate driver and the lighting test circuit; and a second power supply line configured to supply a gate low level voltage to the gate driver and at a periphery of the gate driver and the lighting test circuit, wherein the second input line is coupled to the first power supply line or the second power supply line through a resistor.

The lighting test circuit may include a plurality of transistors each including a channel layer; a source electrode coupled to the channel layer and coupled to the first input line; a drain electrode coupled to the channel layer and coupled to one of the data lines; and a gate electrode coupled to the second input line.

The channel layer may include a p-type semiconductor material, and the second input line may be coupled to the first power supply line through the resistor.

The channel layer may include an n-type semiconductor material, and the second input line may be coupled to the second power supply line through the resistor.

The resistor may be at a same layer as the channel layer.

The organic light emitting diode (OLED) display may further include a light emission control driver facing the gate driver with the pixel unit interposed between the light emission control driver and the gate driver, on the panel, and configured to supply a light emission control signal to light emission control lines, which are parallel to the gate lines.

The first power supply line may be configured to supply the gate high level voltage to the light emission control driver, and may be at a periphery of the light emission control driver, the gate driver, and the lighting test circuit, and the second power supply line may be configured to supply the gate low level voltage to the light emission control driver, and may be at a periphery of the light emission control driver, the gate driver, and the lighting test circuit.

A high level voltage of the gate signal and the light emission control signal may be configured to be generated according to the gate high level voltage, and a low level voltage of the gate signal and the light emission control signal may be configured to be generated according to the gate low level voltage.

A data driver facing the lighting test circuit with the pixel unit interposed between the data driver and the light test circuit, on the panel, and configured to supply a data signal to the data lines may be further included.

The gate driver and the light emission control driver may be at a right side or a left side of the panel, and the lighting test circuit and the data driver may be at an upper side or a lower side of the panel.

According to embodiments of the present invention, an organic light emitting diode (OLED) display suppressing a defect caused by an ESD is provided.

DETAILED DESCRIPTION

Figure 1:
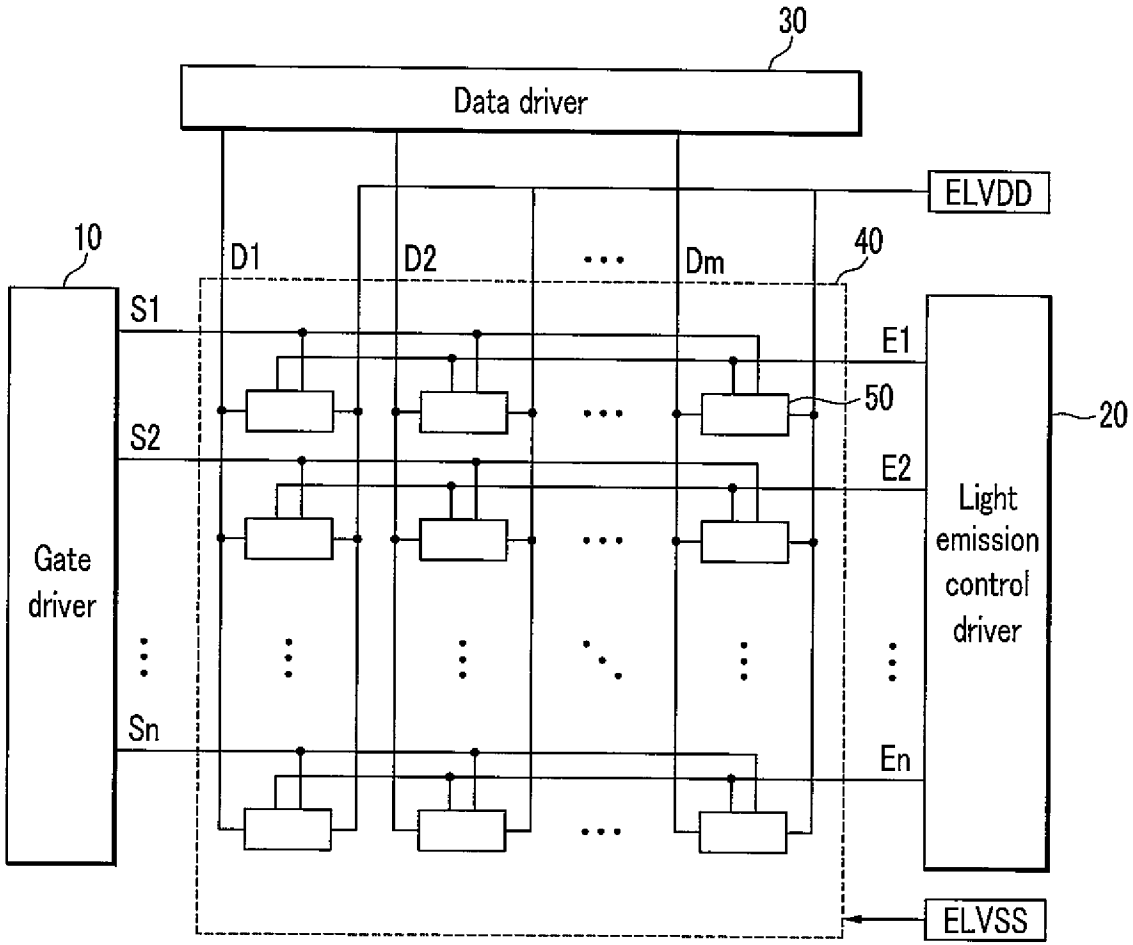
FIG. 1 is a block diagram of an example of an organic light emitting diode (OLED) display.

Hereinafter, exemplary embodiments will be described in detail with reference to the accompanying drawings such that those skilled in the art can easily carry out the present invention. As those skilled in the art would realize, the described embodiments may be modified in various different ways, all without departing from the spirit or scope of the present invention.

To clearly describe the embodiments, parts not necessary to understanding the description may be omitted, and like reference numerals designate like elements throughout the specification.

Elements having the same structures throughout the embodiments are denoted by the same reference numerals and may only be described in reference to one embodiment. In the other embodiments, primarily the elements which differ from elements of previously described embodiments are described.

In the drawings, the sizes and thicknesses of the components are merely shown for convenience of explanation, and therefore the present invention is not necessarily limited to the illustrations described and shown herein.

In addition, unless explicitly described to the contrary, the word "comprise" and variations such as "comprises" or "comprising" will be understood to imply the inclusion of stated elements but not the exclusion of one or more other elements. Also, when an element is referred to as being "coupled" (e.g., electrically coupled or connected) to another element, it may be directly coupled to the another element or be indirectly coupled to the another element with one or more intervening elements interposed therebetween.

The pixel represents a minimum unit for displaying an image, and the organic light emitting diode (OLED) display expresses the image through a plurality of pixels.

An organic light emitting diode (OLED) display according to an embodiment of the present invention will now be described with reference to FIG. 1 to FIG. 7.

FIG. 1 is a block diagram of one example of an organic light emitting diode (OLED) display.

As shown in FIG. 1, the organic light emitting diode (OLED) display includes a gate driver 10, a light emission control driver 20, a data driver 30, and a pixel unit 40.

The gate driver 10 generates a gate signal corresponding to a driving power and a control signal supplied from an external source, and sequentially supplies the gate signal to the gate lines S1 to Sn. The pixels 50 are selected by the gate signal, and thereby the data signals are sequentially supplied.

The light emission control driver 20 sequentially supplies a light emission control signal to the light emission control lines E1 to En disposed in parallel to the gate lines S1 to Sn. The light emission control signals correspond to the driving power and the control signals. Thus, the light emission of the pixels 50 is controlled by the light emission control signal.

The gate driver 10 and the light emission control driver 20 may be separately mounted on the panel as a chip type. Alternatively, they may be formed on the panel along with the driving elements included in the pixel unit 40.

In FIG. 1, the gate driver 10 and the light emission control driver 20 are disposed to face each other with the pixel unit 40 interposed therebetween, however, the present invention is not limited thereto. For example, the gate driver 10 and the light emission control driver 20 may be formed at the same side of the pixel unit 40, or may be respectively formed on both sides of the pixel unit 40.

Also, the light emission control driver 20 may be omitted according to the structure of the pixels 50 of the pixel unit 40.

The data driver 30 generates the data signal corresponding to the data and control signals supplied from the outside source and supplies the data signal to the data lines D1 to Dm. The data signal supplied to the data lines D1 to Dm is supplied to the pixels 50 selected by the gate signal (i.e., when the gate signal is supplied to the pixel 50). Thus, the pixels 50 store or charge a voltage corresponding to the data signal.

The pixel unit 40 includes a plurality of pixels 50 positioned at crossing regions of the gate lines S1 to Sn, the light emission control lines E1 to En, and the data lines D1 to Dm.

The pixel unit 40 may receive a first power ELVDD of a high potential pixel power and a second power ELVSS of a low potential pixel power from the outside source. The first power ELVDD and the second power ELVSS are transmitted to each of pixels 50. Also, the pixel unit 40 may be supplied with an initialization power Vinit or a reference voltage Vref according to the structure of the pixels 50.

Thus, the pixels 50 emit light with a luminance corresponding to a driving current flowing from the first power ELVDD to the second power ELVSS, the driving current corresponding to the data signal, and thereby displaying images.

Figure 2:
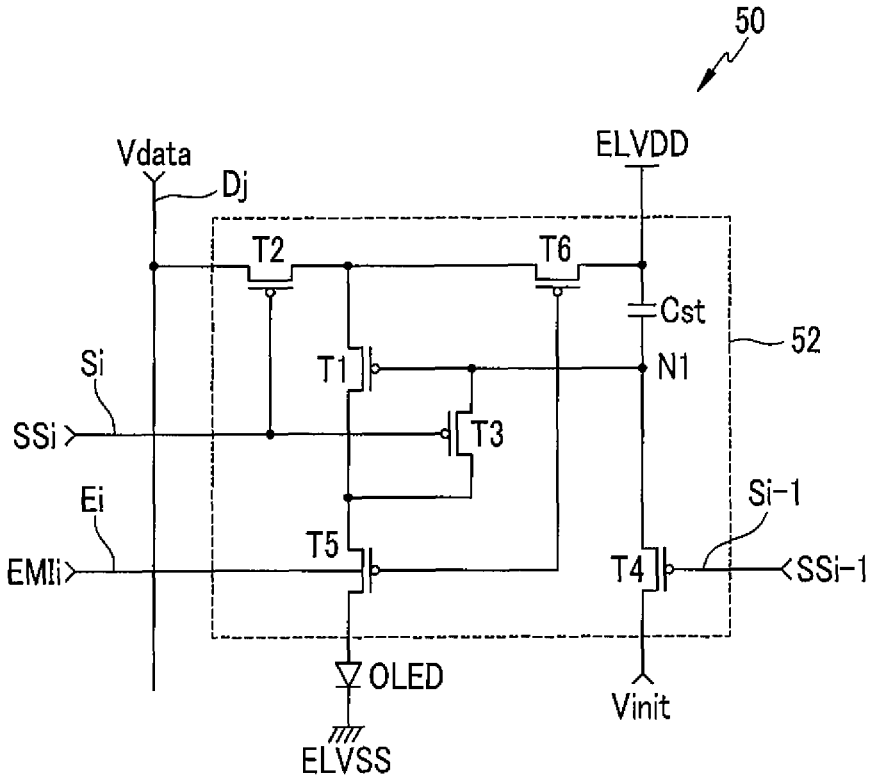
FIG. 2 is a circuit diagram of an example of the pixel shown in FIG. 1.

FIG. 2 is a circuit diagram of one example of the pixel 50 shown in FIG. 1. For convenience, FIG. 2 shows a pixel positioned at an i-th (i is a natural number) row and a j-th (j is the natural number) column, and the pixel is configured to perform initialization and threshold voltage compensation. However, the present invention is not limited thereto, and the present invention may include pixels of various structures.

As shown in FIG. 2, the pixel 50 includes a pixel circuit unit 52 including a plurality of transistors T1 to T6, a storage capacitor Cst, and an organic light emitting diode (OLED) for receiving the driving current from the pixel circuit unit 52.

The pixel circuit unit 52 initializes the voltage stored in the storage capacitor Cst when the previous gate signal SSi−1 is supplied to the previous gate line Si−1, and charges the voltage corresponding to the data signal Vdata and the threshold voltage of the first transistor T1 when the current gate signal SSi is supplied from the current gate line Si. Then, the driving current corresponding to the data signal Vdata is supplied to the organic light emitting diode (OLED) regardless of the threshold voltage of the first transistor T1.

In this case, although not shown in FIG. 1, each of pixels 50 may be coupled to the previous gate line Si−1 as well as the current gate line Si, and the first row of the pixels 50 may be coupled to a gate line in the previous row to the first gate line S1 (e.g., a dummy gate line) to initialize the first row of the pixels 50. Also, in the pixel unit 50, an initialization power line to supply initialization power Vinit to each of the pixels 50 may be further included.

In FIG. 2, the pixel circuit unit 52 is coupled to the current gate line Si, the previous gate line Si−1, the light emission control line Ei, the data line Dj, the first power ELVDD, the initialization power Vinit, and the organic light emitting diode (OLED), and includes the first to the sixth transistors T1 to T6 and the storage capacitor Cst.

The first transistor T1 may be coupled between the first power ELVDD and the organic light emitting diode (OLED) to control the driving current according to the voltage applied to the gate electrode of the first transistor T1.

In detail, the first electrode (e.g., a source electrode) of the first transistor T1 may be coupled to the first power ELVDD through the sixth transistor T6 and the second electrode of T1 (e.g., a drain electrode) may be coupled to the organic light emitting diode (OLED) through the fifth transistor T5. Also, the gate electrode of the first transistor T1 may be coupled to the first node N1. Here, the first transistor T1 controls the driving current supplied to the organic light emitting diode (OLED) according to the voltage of the first node N1, that is, the voltage charged to the storage capacitor Cst.

The second transistor T2 may be coupled between the data line Dj and the storage capacitor Cst, and may be turned on when the current gate signal SSi is supplied from the current gate line Si such that the data signal is transmitted inside the pixel 50.

In FIG. 2, the first electrode of the second transistor T2 is coupled to the data line Dj, and the second electrode of the second transistor T2 is coupled to the storage capacitor Cst through the first and third transistors T1 and T3. Also, the gate electrode of the second transistor T2 is coupled to the current gate line Si. Here, the second transistor T2 is turned on when the current gate signal SSi is supplied from the current gate line Si such that the data signal Vdata supplied from the data line Dj is transmitted to the storage capacitor Cst through the first and third transistors T1 and T3.

The third transistor T3 may be coupled to the gate electrode of the first transistor T1 and the second electrode (e.g., the drain electrode) of the first transistor T1. As such, the third transistor T3 may diode-connect the first transistor T1 according to the voltage applied to the gate electrode of the third transistor T3.

In FIG. 2, the first electrode of the third transistor T3 is coupled to the second electrode of the first transistor T1 and the second electrode of the third transistor T3 is coupled to the gate electrode of the first transistor T1. Also, the gate electrode of the third transistor T3 is coupled to the current gate line Si. Here, the third transistor T3 is turned on when the current gate signal SSi is supplied from the current gate line Si to diode-connect the first transistor T1.

The fourth transistor T4 may be coupled between the storage capacitor Cst and the initialization power Vinit, and may be turned on by the previous gate signal SSi−1 to transmit the voltage of the initialization power Vinit to the storage capacitor Cst.

Here, the initialization power Vinit is a power that does not form part of the current path from the first power ELVDD to the second power ELVDD, and is a power for supplying a constant voltage to the pixel circuit unit 52 at a period (e.g., a period in which the previous gate signal SSi−1 is supplied to the previous gate line Si−1) before the current gate signal SSi is supplied to the current gate line Si. This initialization power Vinit may be set as a lower voltage than a voltage of the data signal Vdata, for example, a lowest voltage of the data signal Vdata.

If the fourth transistor T4 is turned on, the voltage of the first node N1 is initialized by a voltage lower than the voltage of the data signal Vdata, and the data signal Vdata is supplied to the first node N1 while the first transistor T1 is diode-connected in a forward direction during a writing period of the following data signal Vdata.

In FIG. 2, the first electrode of the fourth transistor T4 is coupled to the first node N1, and the second electrode of the fourth transistor T4 is coupled to the initialization power Vinit. Also, the gate electrode of the fourth transistor T4 is coupled to the previous gate line Si−1. Here, the fourth transistor T4 is turned on when the previous gate signal SSi−1 is supplied from the previous gate line Si−1 such that the initialization power Vinit and the first node N1 are coupled. Accordingly, when the voltage of the initialization power Vinit is applied to the first node N1, the voltage of the first node N1 is initialized.

The fifth transistor T5 may be coupled between the first transistor T1 and the organic light emitting diode (OLED). The turn-off of the fifth transistor T5 may be controlled by the light emission control signal EMIi supplied from the light emission control line Ei.

In FIG. 2, the first electrode of the fifth transistor T5 is coupled to the second electrode of the first transistor T1, and the second electrode of the fifth transistor is coupled to the anode of the organic light emitting diode (OLED). Also, the gate electrode of the fifth transistor T5 is coupled to the light emission control line Ei. Here, the fifth transistor T5 is turned off when the voltage level of the light emission control signal EMIi supplied from the light emission control line Ei is a high level such that the pixel circuit unit 52 and the organic light emitting diode (OLED) are insulated from each other, and if the voltage level of the light emission control signal EMIi is transitioned to the low level, the fifth transistor is turned on such that the driving current supplied from the first transistor T1 is transmitted to the organic light emitting diode (OLED).

The sixth transistor T6 may be coupled between the first power ELVDD and the first transistor T1, and the turn-off thereof may be controlled by the light emission control signal EMIi supplied from the light emission control line Ei.

In FIG. 2, the first electrode of the sixth transistor T6 is coupled to the first power ELVDD, and the second electrode of the sixth transistor T6 is coupled to the first electrode of the first transistor T1. Also, the gate electrode of the sixth transistor T6 is coupled to the light emission control line Ei. Here, the sixth transistor T6 is turned off when the voltage level of the light emission control signal EMIi supplied from the light emission control line Ei is the high level such that the first transistor T1 and the first power ELVDD are insulated, and if the voltage level of the light emission control signal EMIi is transitioned into the low level, it is turned on such that the first transistor T1 and the first power ELVDD are coupled.

The storage capacitor Cst may be coupled between the gate electrode of the first transistor T1 and the first power ELVDD. This storage capacitor Cst may be initialized by the initialization power Vinit during a period in which the previous gate signal SSi−1 is supplied, and may be charged with a voltage corresponding to the data signal Vdata and the threshold voltage of the first transistor T1 during a period in which the current gate signal SSi is supplied. The storage capacitor Cst may maintain the charged voltage during a period in which the pixel 50 emits the light.

In FIG. 2, the organic light emitting diode (OLED) is coupled between the pixel circuit unit 52 and the second power ELVSS. Here, the organic light emitting diode emits light with a luminance corresponding to the driving current flowing into the second power ELVSS through the pixel circuit unit 52 and itself from the first power ELVDD. The organic light emitting diode (OLED) may include organic emission layers for emitting light of red, green, or blue, thereby generating light corresponding thereto.

Figure 3:
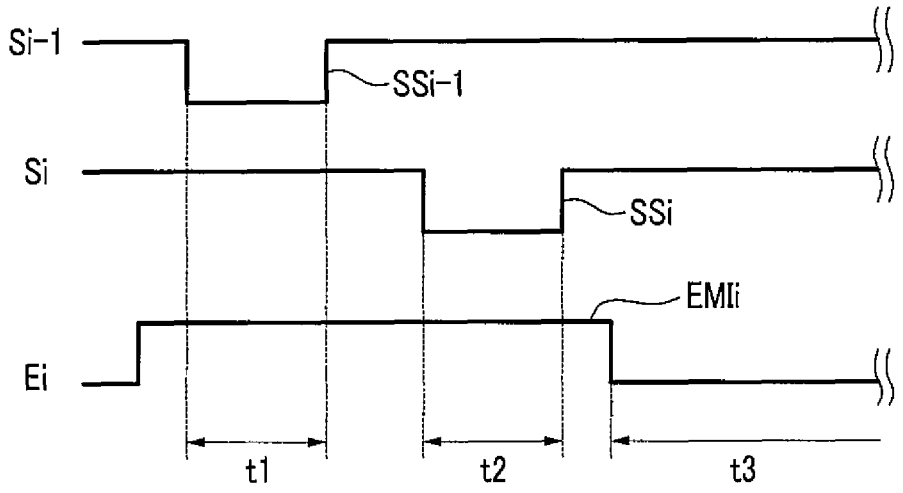
FIG. 3 is a waveform diagram of a driving method of the pixel shown in FIG. 2.

FIG. 3 is a waveform diagram of a driving method of the pixel shown in FIG. 2.

As shown in FIG. 3, the pixel 50 may sequentially receive (e.g., sequentially receive at a low level) the previous gate signal SSi−1 and the current gate signal SSi from the previous gate line Si−1. The current light emission control signal EMIi of the current light emission control line Ei may be supplied at a high level such that it overlaps a sequence of the previous gate signal SSi−1 at the low level and then the current gate signal SSi at the low level.

That is, the light emission control signal EMIi maintains the voltage of the high level for turning off the fifth transistor T5 and the sixth transistor T6 during a period in which the previous gate signal SSi−1 and the current gate signal SSi are supplied, and after the supply of the current gate signal SSi is completed, it is transitioned into the voltage of the low level for turning on the fifth transistor T5 and the sixth transistor T6.

Thus, the pixel 50 receives the first power ELVDD, the second power ELVSS, and the initialization power Vinit from the outside source, and the data signal Vdata from the data line Dj.

By way of illustration, an example operation of the pixel 50 will now be described in detail. First, the fourth transistor T4 is turned on during the first period t1 in which the previous gate signal SSi−1 of the low level is supplied to the previous gate line Si−1. Thus, the voltage of the initialization power Vinit is transmitted to the first node N1 such that the voltage of the first node N1 is initialized, and thereby the voltage stored to the storage capacitor Cst is also initialized. That is, the first period t1 is a period for initializing the voltage of the first node N1.

Next, during the second period t2 in which the current gate signal SSi at the low level is supplied to the current gate line Si, the second transistor T2 and the third transistor T3 are turned on. If the second transistor T2 and the third transistor T3 are turned on, the data signal Vdata supplied from the data line Dj is transmitted to the first node N1 from the second transistor T2, the first transistor T1, and the third transistor T3. Accordingly, the first transistor T1 is diode-connected by the third transistor T3 such that the first node N1 receives a voltage reflected by the threshold voltage of the first transistor T1 as well as the data signal Vdata.

That is, the storage capacitor Cst is charged with the voltage corresponding to the data signal Vdata and the threshold voltage of the first transistor T1.

Next, during the third period t3, the voltage level of the light emission control signal EMIi supplied to the light emission control line Ei is transitioned to the low level, and the fifth transistor T5 and the sixth transistor T6 are turned on.

Thus, the driving current corresponding to the voltage charged in the storage capacitor Cst is supplied to the organic light emitting diode (OLED) by the first transistor T1.

Because the threshold voltage of the first transistor T1 is offset, the organic light emitting diode (OLED) is supplied with the driving current corresponding to the data signal Vdata regardless of the threshold voltage of the first transistor T1. Accordingly, the organic light emitting diode (OLED) emits light with a uniform luminance corresponding to the data signal Vdata regardless of the threshold voltage of the first transistor T1.

The previous gate signal SSi−1 and the current gate signal SSi driving the pixel 50 may be generated by the gate driver 10 shown in FIG. 1, and the light emission control signal EMIi may be generated by the light emission control driver 20.

Figure 4:
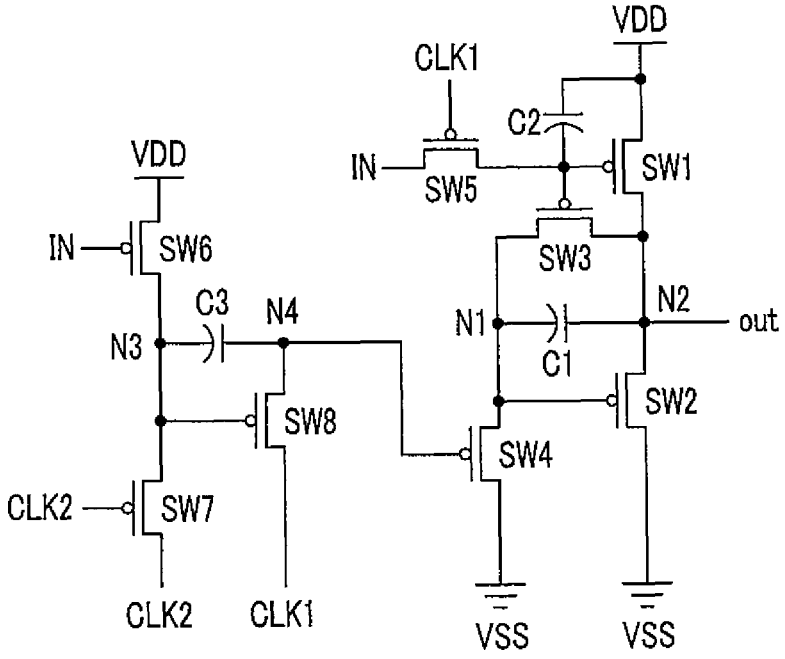
FIG.4 (RELATED ART)
FIG. 4 is a circuit diagram of an example of a shift register provided in the gate driver shown in FIG. 1.
Figure 5:
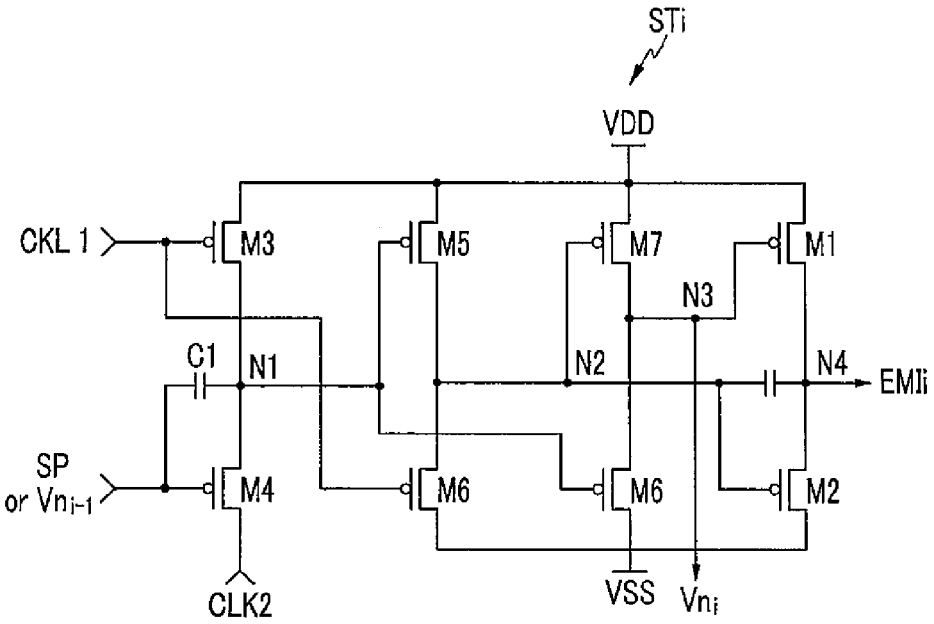
FIG.5 (RELATED ART)
FIG. 5 is a circuit diagram of an example of a shift register provided in the light emission control driver shown in FIG. 1.

FIG. 4 is a circuit diagram of an example of a shift register that may be provided in the gate driver shown in FIG. 1. FIG. 5 is a circuit diagram of an example of a shift register that may be provided in the light emission control driver shown in FIG. 1. Particularly, FIG. 4 and FIG. 5 are circuit diagrams showing a constitution of an i-th stage among a plurality of stages respectively included in the shift register of the gate driver and the light emission control driver.

FIG. 4 shows the stage circuit of a shift register disclosed in KR Patent No. 0759686, and the output signal of the stage, that is, the high level voltage of the gate signal is due to the first power VDD of the shift register, and the low level voltage of the gate signal is due to the second power VSS of the shift register.

Here, the first power VDD and the second power VSS of the shift register mean the driving power of the gate driver including the shift register, however they are only indicated by different terms and correspond to the gate high level voltage VGH and the gate low level voltage VGL respectively supplied to the gate driver in actuality.

Also, FIG. 5 shows a stage STi circuit of a shift register disclosed in Korean Patent Laid-Open Publication No. 2008-0033630, and the output signal of the stage STi, that is, the high level voltage of the light emission control signal EMIi is due to the first power VDD of the light emission control driver, and the low level voltage of the light emission control signal EMIi is due to the second power VSS of the light emission control driver.

Here, the light emission control driver may be included with the gate driver or may be separately provided from the gate driver, and the gate driver and the light emission control driver may be equally driven by the first power VDD and the second power VSS, that is, the gate high level voltage VGH and the gate low level voltage VGL.

Accordingly, to drive the pixels by the gate driver and the light emission control driver, the gate high level voltage VGH and the gate low level voltage VGL may be stably supplied through them.

Figure 6:
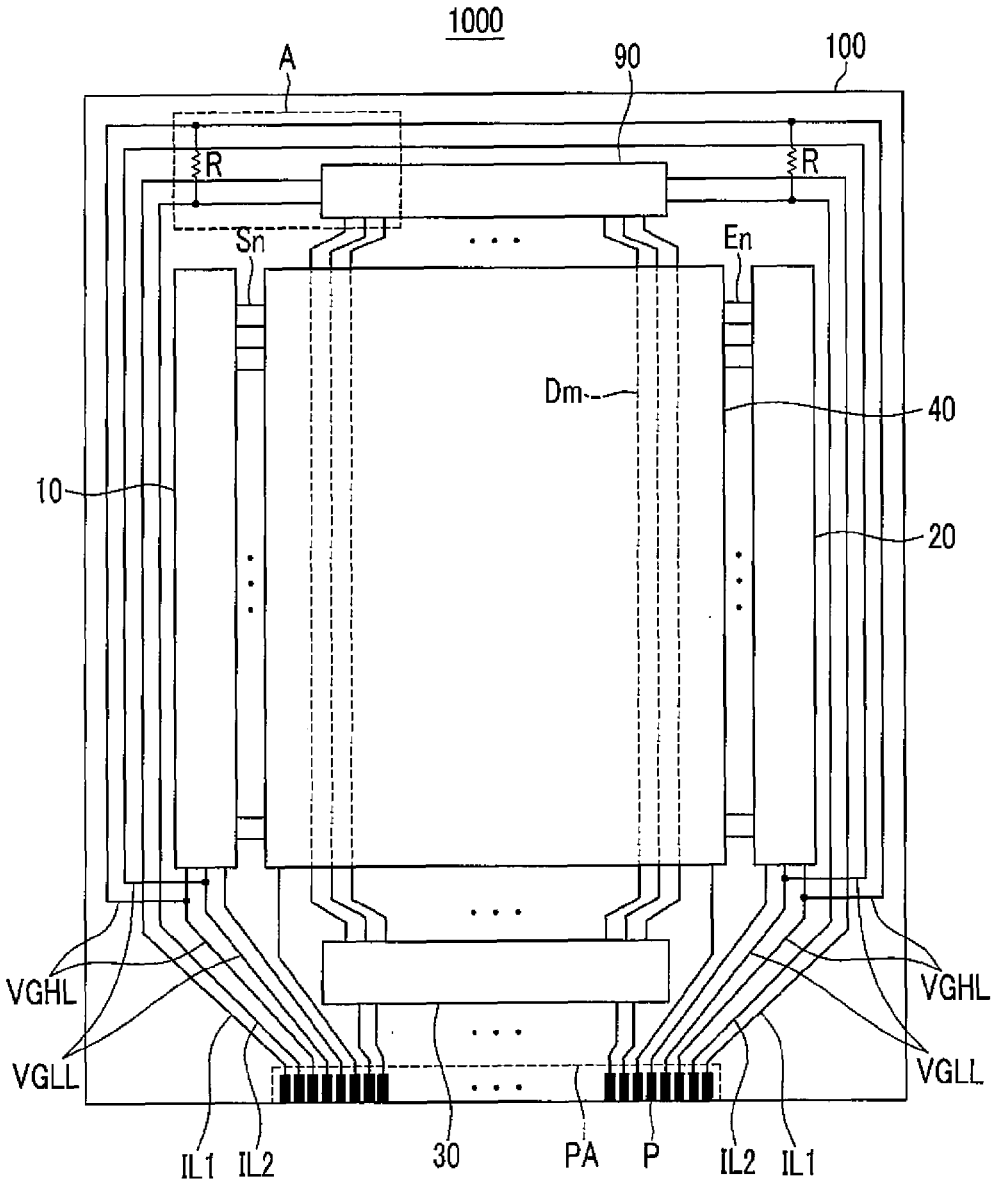
FIG. 6 is a top plan view of an organic light emitting diode (OLED) display according to an embodiment of the present invention.

FIG. 6 is a top plan view of an organic light emitting diode (OLED) display according to an embodiment of the present invention. In the device of FIG. 6, one or more features of the devices shown in FIGS. 1-5 may be selected.

As shown in FIG. 6, the organic light emitting diode (OLED) display 1000 according to the embodiment may include a pixel unit 40 (shown here at a center region of the panel 100), a gate driver 10 (shown here at one side of the panel 100) for supplying a gate signal to the gate lines Sn, a light emission control driver 20 (shown here as facing the gate driver 10 with the pixel unit 40 interposed therebetween and on the panel 100) for supplying the light emission control signal to the light emission control lines En positioned parallel to the gate lines Sn, a lighting test circuit 90 (shown here at an other side of the panel 100), and a data driver 30 (shown here positioned to face the lighting test circuit 90 with the pixel unit 40 interposed therebetween and on the panel 100) for supplying the data signal to the data lines Dm.

In FIG. 6, the gate driver 10 is disposed at the left side of the pixel unit 40, that is, the left side of the panel 100, and the light emission control driver 20 is disposed at the right side of the pixel unit 40, that is, the right side of the panel 100, however it is not limited thereto, and the gate driver 10 may be disposed at the right side of the pixel unit 40, that is, the right side of the panel 100, and the light emission control driver 20 may be disposed at the left side of the pixel unit 40, that is, the left side of the panel 100. That is, the gate driver 10 and the light emission control driver 20 may be disposed at the right side or the left side of the panel 100 with the pixel unit 40. Also, in this embodiment, the gate driver 10 and the light emission control driver 20 are separated and positioned to face each other with reference to the pixel unit 40, however, they may be integrated into one driver and may be formed at one side or both sides of the pixel unit 40. Additionally, the light emission control driver 20 may be omitted according to the structure of the pixel embodiment.

Also, in FIG. 6, the lighting test circuit 90 is positioned at the upper side of the pixel unit 40, that is, the upper side of the panel 100, and the data driver 30 is positioned at the lower side of the pixel unit 40, that is, the lower side of the panel 100; however, it is not limited thereto, and the lighting test circuit 90 may be positioned at the lower side of the pixel unit 40, that is, the lower side of the panel 100, and the data driver 30 may be positioned at the upper side of the pixel unit 40, that is, the upper side of the panel 100. Also, in this embodiment, the lighting test circuit 90 and the data driver 30 are separated and positioned to face to each other with reference to the pixel unit 40; however, they may be integrated into one driver and may be formed at one side or both sides of the pixel unit 40.

A pad portion PA may be positioned at an edge of the panel 100 where the gate driver 10, the light emission control driver 20, the data driver 30, and the lighting test circuit 90 are not positioned, for example, the lower edge, and may include a plurality of pads P to supply the driving power and the control signal inside the panel 100. According to an embodiment of the present invention, the pixel unit 40, the gate driver 10, the light emission control driver 20, the lighting test circuit 90, and the data driver 30 are supplied with the driving power and the control signal through the pads P.

Also, a first power supply line VGHL (or lines) for receiving the gate high level voltage from the pad portion PA, and for supplying the gate high level voltage to the gate driver 10 and the light emission control driver 20 may be included on (e.g., formed or disposed on/in) the panel 100. The first power supply line VGHL may be designed with a shape that encloses (e.g., along a periphery of, around, surrounding, or partially surrounding at least a portion of) the pixel unit 40, the gate driver 10, the lighting test circuit 90, and the light emission control driver 20, and may be coupled to a plurality of pads P of the pad portion PA. A second power supply line VGLL (or lines) for receiving the gate low level voltage from the pad portion PA, and for supplying the gate low level voltage to the gate driver 10 and the light emission control driver 20 may be included on the panel 100. The second power supply line VGLL may be designed with a shape that encloses (e.g., around a periphery of, etc.) the pixel unit 40, the gate driver 10, the lighting test circuit 90, and the light emission control driver 20, and may be coupled to a plurality of pads P of the pad portion PA.

In an embodiment, the first power supply line VGHL and the second power supply line VGLL may be respectively divided to detour the gate driver 10 and the light emission control driver 20, however, in the organic light emitting diode (OLED) display according to other embodiments, the first power supply line VGHL and the second power supply line VGLL may be designed with a shape enclosing (e.g., around a periphery of, etc.) the lighting test circuit 90 through the gate driver 10 and the light emission control driver 20.

Also, to reduce (or minimize) the voltage drop in the panel 100, the first power supply line VGHL and the second power supply line VGLL may be formed with a material having low resistivity. For example, the first power supply line VGHL and the second power supply line VGLL may be formed with the same layer and the same material as source and drain electrodes of the transistors (e.g., the transistors included in the pixel unit 40, the gate driver 10, and the light emission control driver 20) formed on the panel 100, or the same layer and the same material as the gate electrode of the transistors. Also, the first power supply line VGHL and the second power supply line VGLL may be formed with the same material as the source and drain electrodes of the transistors in one region and may be formed with the same material as the gate electrode of the transistors in the other region, and thereby the source and drain electrode material of the transistors or the gate electrode material may be used. That is, the first power supply line VGHL and the second power supply line VGLL may be freely designed by selecting the material having low resistivity among the materials used to form the panel 100.

The first power supply line VGHL and the second power supply line VGLL may be coupled to the gate driver 10 and the light emission control driver 20 through the upper region of the panel 100 facing the pad portion PA. The lighting test circuit 90 may be positioned at the upper region of the panel 100.

Accordingly, the high level voltage of the gate signal generated from the gate driver 10 and the light emission control signal generated from the light emission control driver 20 may be generated with the same level due to the same gate high level voltage VGH supplied from the first power supply line VGHL, and the low level voltage of the gate signal and the light emission control signal may be generated with the same level due to the same gate low level voltage VGL supplied from the second power supply line VGLL.

Accordingly, the gate driver 10 and the light emission control driver 20 may be coupled through the first power supply line VGHL and the second power supply line VGLL such that the gate driver 10 and the light emission control driver 20 may be supplied with the gate high level voltage VGH with the same level and the gate low level voltage VGL with the same level, thereby stably driving the organic light emitting diode (OLED) display 1000.

According to an embodiment of the present invention, the lighting test circuit 90 is coupled to the first input line IL1 and the second input line IL2, receives the lighting test signal from the first input line IL1 (coupled to the pad portion PA) during a lighting test period, and receives the test control signal from the second input line IL2 (coupled to the pad portion PA) to supply the lighting test signal to the data lines Dm according to the test control signal.

The lighting test circuit 90 may maintain an off state due to a bias signal supplied from the pad portion PA during the actual driving period (e.g., when displaying an image) after the lighting test is completed.

The present invention is not limited to the case including the data driver 30, and the data driver 30 may not be included (e.g., included in the operation of the test control signal).

According to embodiments of the present invention, instead of the data driver 30, the lighting test signal may be supplied to the data lines Dm by using the lighting test circuit 90, thereby performing the lighting test before forming the data driver 30 (e.g., during manufacturing). Accordingly, a defective panel may be detected before mounting the data driver 30, and unnecessary material consumption may be prevented.

Figure 7:
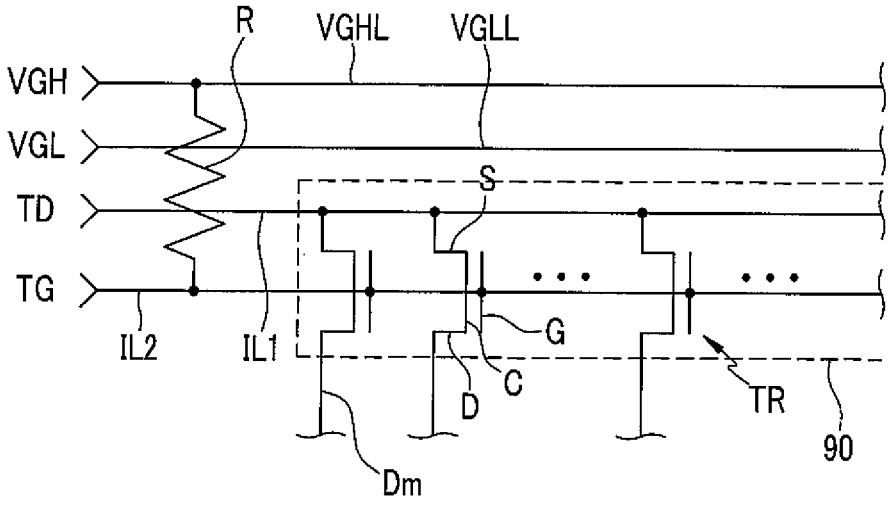
FIG. 7 is a view of a portion A of FIG. 6.

FIG. 7 is a view of a portion A of FIG. 6.

As shown in FIG. 7, the lighting test circuit 90 may include a plurality of transistors TR, which include a channel layer C, a source electrode S coupled to the channel layer C and coupled to the first input line IL1 (which transmits the lighting test signal TD), a drain electrode D coupled to the channel layer C and coupled to the data lines Dm (each transistor may be coupled to a separate data line), and a gate electrode G coupled to the second input line IL2 input (which transmits the lighting control signal TG).

The channel layer C may include a p-type semiconductor in which a hole functions as a carrier.

The source electrodes S of the transistors TR are commonly coupled to the first input line IL1 to receive the lighting test signal TD, and each of the drain electrodes D are coupled to a separate one of the data lines Dm.

The gate electrodes G of the transistors TR are commonly coupled to the second input line IL2 to receive the test control signal TG.

The transistors TR are may be concurrently or simultaneously turned on by the test control signal TG, which is supplied to turn on the transistors TR during the lighting test period, such that the lighting test signal TD may be supplied to the data lines Dm. Also, the lighting test circuit 90 may maintain the off state according to the bias signal supplied through the second input line IL2 from the pad portion PA during the actual driving period after the lighting test is completed.

Here, the second input line IL2, which transmits the lighting control signal TG, may be coupled to the first power supply line VGHL, which transmits the gate high level voltage VGH, through the resistor R.

The resistor R may be formed with the same material and within the same layer as the channel layer C on the panel 100. For example, the resistor R may be the semiconductor material that formed (e.g., concurrently or simultaneously formed) the channel layer C, and may be formed when the channel C is formed.

The resistor R may include a semiconductor material such as a polysilicon semiconductor or oxide semiconductor, and may be integrally formed along with the channel layer C of the transistors TR.

In the described embodiment, the resistance of the resistor R is configured to not affect (or substantially not affect) the lighting test during actual driving, but is configured in a range for protecting the transistors TR from an ESD (e.g., a strong electrostatic shock). The resistance of the resistor R may be changed according to the design conditions of the panel 100 and may be calculated through a simulation. To control the resistance of the resistor R, the semiconductor material, such as, the polysilicon semiconductor or oxide semiconductor, may be doped with an impurity. According to an embodiment of the present invention, if the resistor R is integrally formed with the channel layer C of the transistors TR, only the semiconductor material for the resistor R may be doped with the impurity. Alternatively, in other embodiments, the channel layer C of the transistors TR and the resistor R may be doped with the same impurity, or a concentration of the impurity doped to the semiconductor material for the resistor R may be controlled to be different from the concentration of the impurity doped to the channel layer C of the transistors TR.

As described above, the second input line IL2 may be coupled to the first power supply line VGHL through the resistor R such that the floating of the second input line IL2 by the ESD is suppressed and the gate electrode G of the transistors TR maintains the off state due to the gate high level voltage VGH supplied from the first power supply line VGHL during the actual driving period after the lighting test is completed (although the second input line IL2 may be partially floated by the ESD).

When a second input line is positioned along (e.g., disposed along at least a part of) the outer part of a panel, and is coupled between a gate electrode of transistors of a lighting test circuit and a pad portion, it may have a structure that is weak (e.g., susceptible) to the ESD that may undesirably be applied to the organic light emitting diode (OLED) display during the actual driving period after the lighting test is completed. Accordingly, if the second input line is partially floated by the ESD, the transistors of the lighting test circuit may not maintain the off state such that the driving defect may be generated in the organic light emitting diode (OLED) display. However, in the organic light emitting diode (OLED) display 1000 according to an embodiment of the present invention, the second input line IL2 (for transmitting the lighting control signal TG) is coupled to the first power supply line VGHL (for transmitting the gate high level voltage VGH) through the resistor R such that floating of the second input line IL2 by the ESD is suppressed, and the gate electrode G of the transistors TR maintains the off state due to the gate high level voltage VGH supplied from the first power supply line VGHL thereby preventing the driving defect (although the second input line IL2 may be partially floated by the ESD). That is, a organic light emitting diode (OLED) display 1000 that prevents a driving defect caused by the ESD is provided.

Next, referring to FIG. 8 and FIG. 9, an organic light emitting diode (OLED) display according to another embodiment will be described.

Hereinafter, primarily characteristics of elements different from the above-described embodiments will be described, and elements which are not described are given by way of reference to the above descriptions. In this embodiment, the same reference numerals as those of the first embodiment will be used for the same elements.

Figure 8:
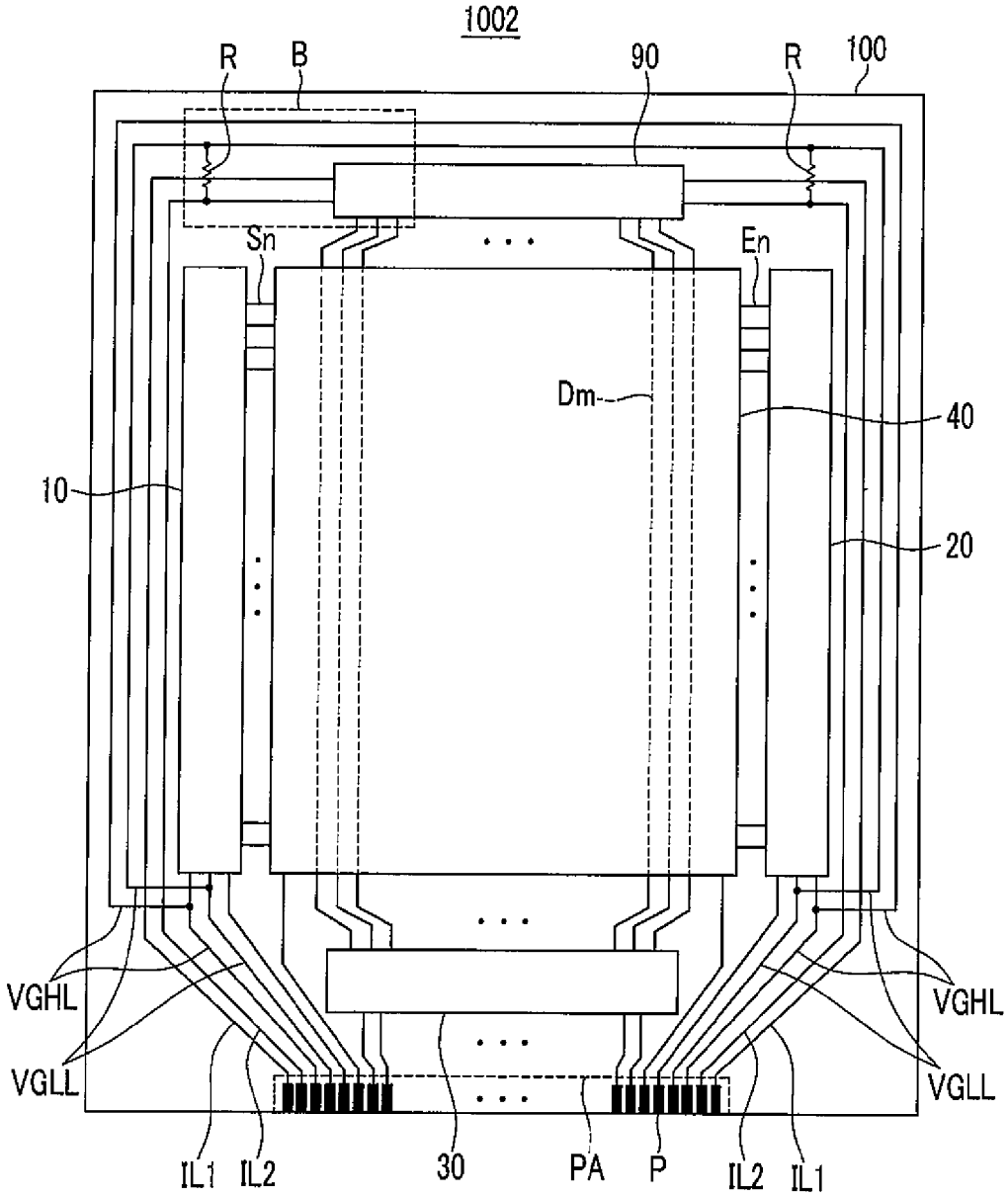
FIG. 8 is a top plan view of an organic light emitting diode (OLED) display according to another embodiment of the present invention.

FIG. 8 is a top plan view of an organic light emitting diode (OLED) display according to an embodiment of the present invention. FIG. 9 is a view of a portion B of FIG. 8.

Figure 9:
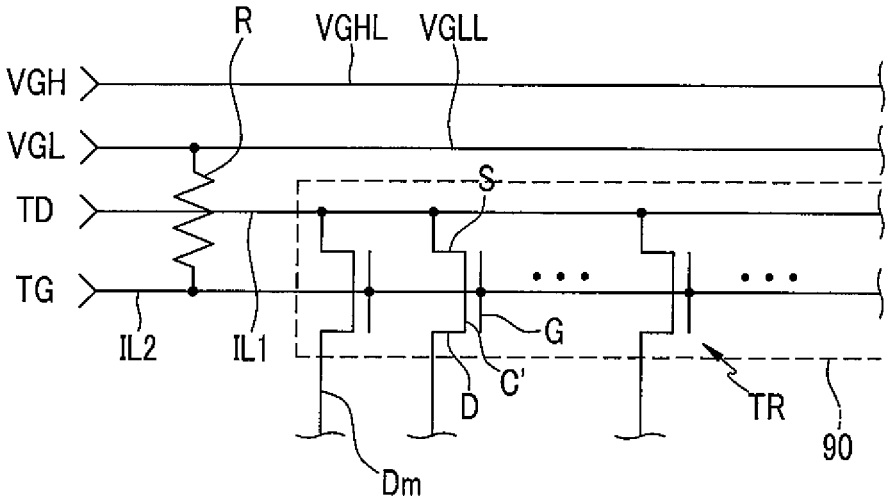
FIG. 9 is a view of a portion B of FIG. 8.

As shown in FIG. 8 and FIG. 9, a lighting test circuit 90 of an organic light emitting diode (OLED) display 1002 according to the an embodiment of the present invention includes a plurality of transistors TR, which each include a channel layer C', the source electrode S coupled to the channel layer C' and coupled to the first input line IL1 (which transmits the lighting test signal TD), the drain electrode D coupled to the channel layer C' and coupled to a data line Dm, and the gate electrode G coupled to the second input line IL2 (which transmits the lighting control signal TG).

According to an embodiment of the present invention, the channel layer C' includes an n-type semiconductor in which an electron functions as the carrier.

The source electrodes S of the transistors TR may be commonly coupled to the first input line IL1 (which transmits the lighting test signal TD), and the drain electrodes D may be coupled to each of data lines Dm (e.g., each of the drain electrodes is coupled to a different data line Dm).

The gate electrode G of the transistors TR may be commonly coupled to the second input line IL2 (which receives the test control signal TG).

The transistors TR may be concurrently or simultaneously turned on by the test control signal TG, which is supplied to turn on the transistors TR during the lighting test period, such that the lighting test signal TD is supplied to the data lines Dm. Also, the lighting test circuit 90 may maintain the off state by the bias signal supplied through the second input line IL2 from the pad portion PA during the actual driving period after the lighting test is completed.

In FIG. 9, the second input line IL2 (which receives the lighting control signal TG) is coupled to the second power supply line VGLL (which receives the gate low level voltage VGL) through the resistor R.

The resistor R may be formed with the same material and within the same layer as the channel layer C' on the panel 100. That is, the resistor R may be a semiconductor material that is formed (e.g., simultaneously or concurrently formed) with the channel layer C'.

The resistor R may include a semiconductor material, such as a polysilicon semiconductor or an oxide semiconductor, and may be formed (e.g., integrally formed) along with the channel layers C' of the transistors TR.

As described above, the second input line IL2 may be coupled to the second power supply line VGLL through the resistor R such that the floating of the second input line IL2 by the ESD is suppressed and the gate electrode G of the transistors TR may maintain the off state due to the gate low level voltage VGL supplied from the second power supply line VGLL during the actual driving period after the lighting test is completed (although the second input line IL2 may be partially floated by the ESD).

The second input line IL2 may be located along (e.g., around, surround, or enclose at least part of) the outer part of a panel and may be coupled between a gate electrode of transistors of a lighting test circuit and a pad portion, thereby having a structure that is weak (e.g., susceptible) to the ESD that may be undesirably applied to an organic light emitting diode (OLED) display during the actual driving period after the lighting test is completed. Accordingly, when a second input line is partially floated by the ESD, the transistors of the lighting test circuit may not maintain the off state such that the driving defect may be generated in the organic light emitting diode (OLED) display. However, in the organic light emitting diode (OLED) display 1002 according to an embodiment of the present invention, the second input line IL2 (which transmits the lighting control signal TG) is coupled to the second power supply line VGLL (which transmits the gate low level voltage VGL) through the resistor R such that floating of the second input line IL2 by the ESD is suppressed and the gate electrode G of the transistors TR maintains the off state due to the gate low level voltage VGL supplied from the second power supply line VGLL thereby preventing the driving defect (although the second input line IL2 may be partially floated by the ESD). That is, an organic light emitting diode (OLED) display 1002 that prevents the driving defect by the ESD is provided.

While this disclosure has been described in connection with what is presently considered to be practical exemplary embodiments, ft is to be understood that the invention is not limited to the disclosed embodiments, but, on the contrary, is intended to cover various modifications and equivalent arrangements included within the spirit and scope of the appended claims.

What is claimed is:

1. An organic light emitting diode (OLED) display comprising:

a pixel unit comprising a plurality of pixels at crossing regions of gate lines and data lines and at a center region of a panel;

a gate driver configured to supply a gate signal to the gate lines, the gate driver being at one side of the panel;

a lighting test circuit coupled to a first input line, configured to transmit a lighting test signal, and a second input line, configured to transmit a test control signal, the lighting test circuit being at an other side of the panel, and being configured to supply the lighting test signal to the data lines according to the test control signal;

a first power supply line configured to supply a gate high level voltage to the gate driver and at a periphery of the gate driver and the lighting test circuit; and a second power supply line configured to supply a gate low level voltage to the gate driver and at a periphery of the gate driver and the lighting test circuit, wherein the second input line is directly coupled to the first power supply line or the second power supply line through a resistor.

2. The organic light emitting diode (OLED) display of claim 1, wherein the lighting test circuit comprises a plurality of transistors each comprising:

a channel layer;

a source electrode coupled to the channel layer and coupled to the first input line;

a drain electrode coupled to the channel layer and coupled to one of the data lines; and a gate electrode coupled to the second input line.

3. The organic light emitting diode (OLED) display of claim 2, wherein the channel layer comprises a p-type semiconductor material, and the second input line is coupled to the first power supply line through the resistor.

4. The organic light emitting diode (OLED) display of claim 2, wherein the channel layer comprises an n-type semiconductor material, and the second input line is coupled to the second power supply line through the resistor.

5. The organic light emitting diode (OLED) display of claim 2, wherein the resistor is at a same layer as the channel layer.

6. The organic light emitting diode (OLED) display of claim 1, further comprising a light emission control driver facing the gate driver with the pixel unit interposed between the light emission control driver and the gate driver, on the panel, and configured to supply a light emission control signal to light emission control lines, which are parallel to the gate lines.

7. The organic light emitting diode (OLED) display of claim 6, wherein the first power supply line is configured to supply the gate high level voltage to the light emission control driver, and is at a periphery of the light emission control driver, the gate driver, and the lighting test circuit, and the second power supply line is configured to supply the gate low level voltage to the light emission control driver, and is at a periphery of the light emission control driver, the gate driver, and the lighting test circuit.

8. The organic light emitting diode (OLED) display of claim 7, wherein a high level voltage of the gate signal and the light emission control signal is configured to be generated according to the gate high level voltage, and a low level voltage of the gate signal and the light emission control signal is configured to be generated according to the gate low level voltage.

9. The organic light emitting diode (OLED) display of claim 6, further comprising a data driver facing the lighting test circuit with the pixel unit interposed between the data driver and the lighting test circuit, on the panel, and configured to supply a data signal to the data lines.

10. The organic light emitting diode (OLED) display of claim 9, wherein the gate driver and the light emission control driver are at a right side or a left side of the panel, and the lighting test circuit and the data driver are at an upper side or a lower side of the panel.

* * * * *